US006971721B2

(12) United States Patent
Lee

(10) Patent No.: US 6,971,721 B2
(45) Date of Patent: Dec. 6, 2005

(54) CHAIR

(75) Inventor: Steve Lee, Chicago, IL (US)

(73) Assignee: LumiSource, Inc., Elk Grove Village, IL (US)

( * ) Notice: Subject to any disclaimer, the term of this patent is extended or adjusted under 35 U.S.C. 154(b) by 0 days.

(21) Appl. No.: 10/744,948

(22) Filed: Dec. 23, 2003

(65) Prior Publication Data

US 2005/0133977 A1 Jun. 23, 2005

(51) Int. Cl.[7] ..... B65B 5/00; A47C 7/00
(52) U.S. Cl. ..... 297/440.15; 297/440.14; 53/428; 53/449; 53/475
(58) Field of Search ..... D6/334–375; 297/440.11–440.24, 451.5, 452.63; 53/428, 53/452, 473, 449, 475

(56) References Cited

U.S. PATENT DOCUMENTS

D151,270 S 10/1948 Kaufman
D211,462 S 6/1968 Platner
D211,463 S 6/1968 Platner
D211,464 S * 6/1968 Platner ..... D6/364
D211,465 S 6/1968 Platner
D224,635 S 8/1972 Yuenger
D224,867 S 10/1972 Burke
D225,196 S 11/1972 Poisson
D255,297 S 6/1980 Miller
5,301,491 A * 4/1994 Boardman, Jr. et al. ..... 53/428
D420,819 S 2/2000 Adabi
D495,507 S * 9/2004 Lee ..... D6/364

* cited by examiner

*Primary Examiner*—Chris Schwartz
(74) *Attorney, Agent, or Firm*—Pauley Petersen & Erickson

(57) ABSTRACT

A chair includes a seat portion; a backrest surrounding at least a portion of the seat portion; and a base removably positioned beneath the seat portion. The base preferably includes tapered sidewalls that correspond with the backrest when the base is inverted and placed on the seat portion. In such a nested position, the disassembled chair may be efficiently shipped and stored in polyhedral boxes with angled side walls, that may be stacked and alternatingly inverted to take advantage of the angled sidewalls of such boxes.

8 Claims, 4 Drawing Sheets

CHAIR

BACKGROUND OF THE INVENTION

1. Field of the Invention

This invention relates to a chair that includes a base that is inverted and nestable within a seat to provide a compact package for storage and shipping.

2. Description of Related Art

Chairs are typically bulky and difficult to ship and store. A need exists for a chair that may be disassembled to form an efficient package for storing and shipment.

SUMMARY OF THE INVENTION

It is one object of this invention to provide a chair that may be disassembled to nest a base in an inverted manner in a seat portion of the chair.

It is another object of this invention to provide a chair having a base with tapered sidewalls that correspond with a taper of a backrest of the chair.

It is still another object of this invention to provide a chair that may be easily shipped and stored to take advantage of the efficiencies of having a base nested within a seat portion.

According to a preferred embodiment of this invention, a chair includes a seat portion, a backrest and a base. The backrest preferably surrounds at least a portion of the seat portion and may include a plurality of upwardly and outwardly extending members. The base is preferably removably positioned beneath the seat portion using a threaded channel positioned off-center relative to a center of a bottom of the seat portion. A fastener connects the base to the threaded channel and thus the seat portion.

The base preferably includes tapered sidewalls and generally forms a conic section. Such tapered sidewalls preferably inversely correspond with a taper of the backrest so that the base may be inverted and placed on the seat portion. As a result of nesting the base within the seat portion and the backrest, the chair may be packaged, stored and shipped in an efficient manner.

BRIEF DESCRIPTION OF THE DRAWINGS

The drawings show a chair, according to preferred embodiments of this invention, wherein:

as shown in FIG. 6.

DETAILED DESCRIPTION OF THE PREFERRED EMBODIMENTS

Figure 1:
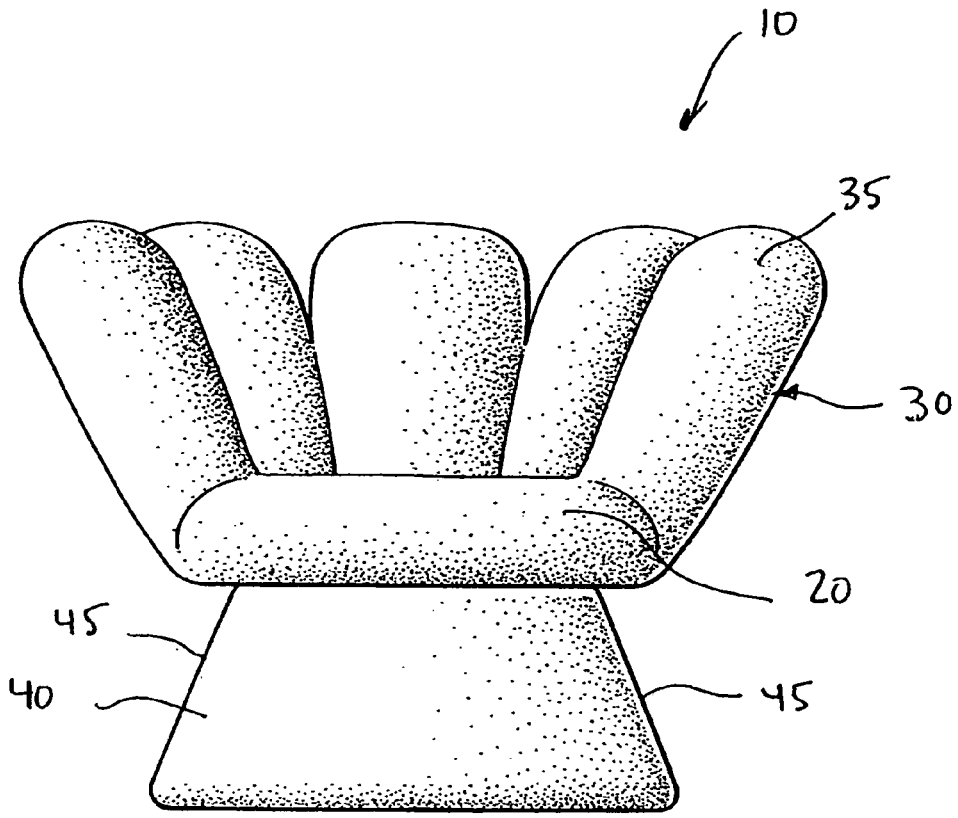
FIG. 1 is a front view of a chair, according to one preferred embodiment of this invention.
Figure 2:
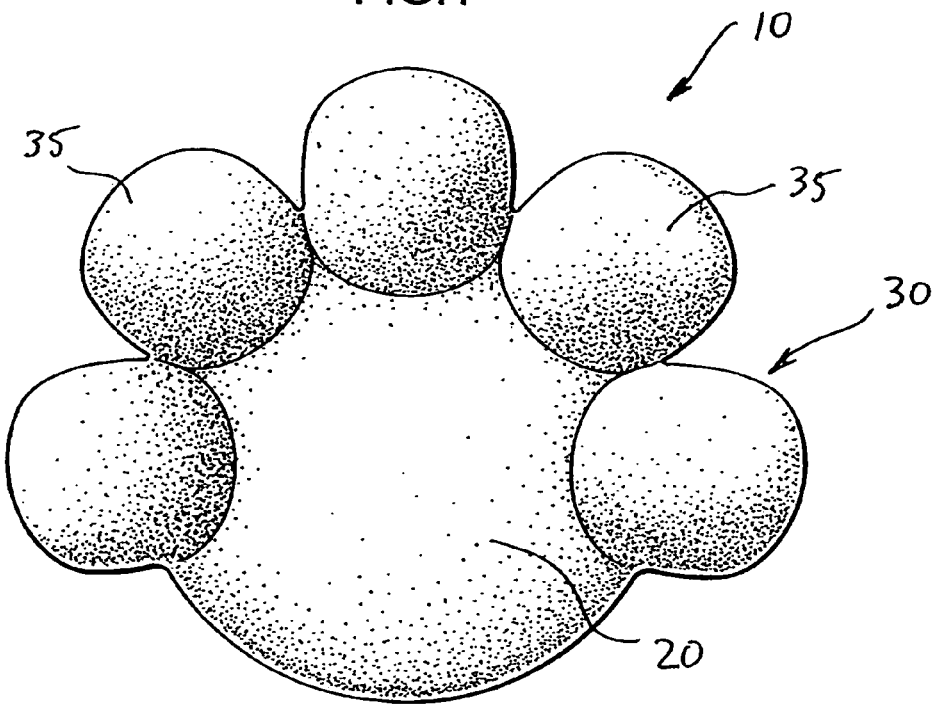
FIG. 2 is a top view of the chair, as shown in FIG. 1.
Figure 3:
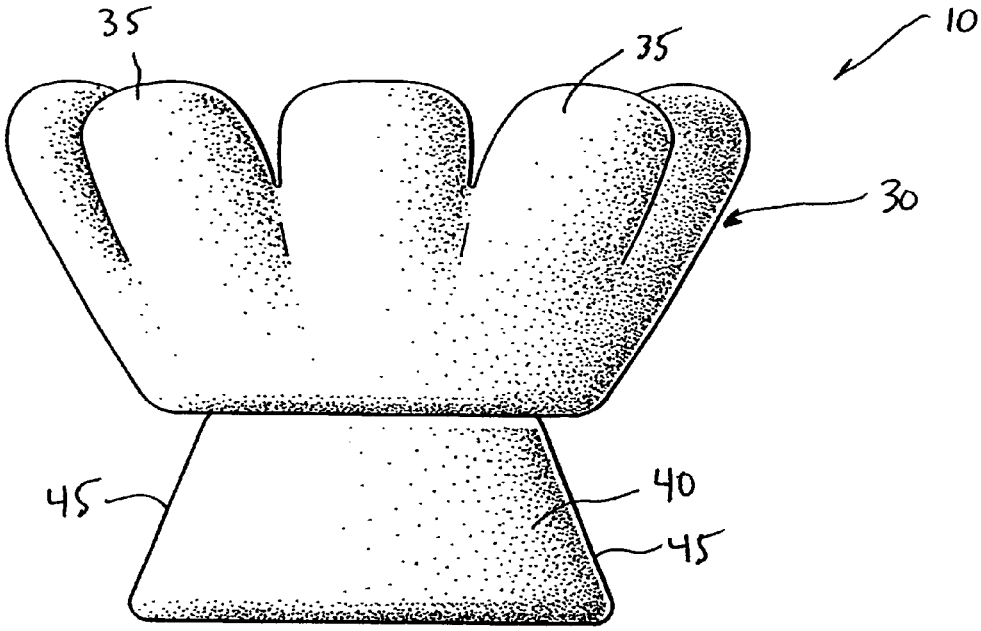
FIG. 3 is a back view of the chair, as shown in FIG. 1.
Figure 4:
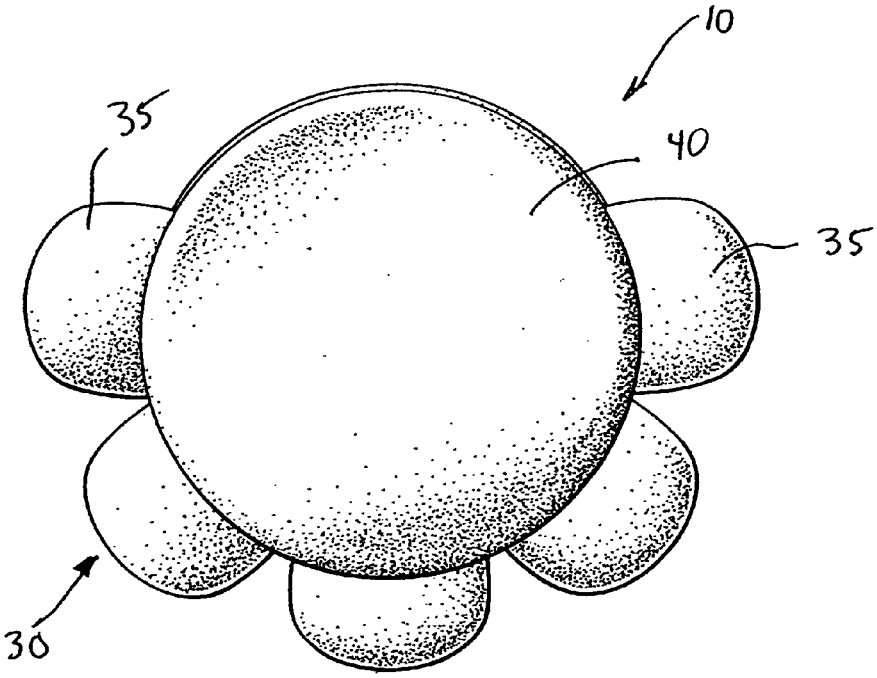
FIG. 4 is a bottom view of the chair, as shown in FIG. 1.

FIGS. 1–6 show various views and embodiments of chair 10 according to preferred embodiments of this invention. As shown in FIG. 1, chair 10 preferably includes seat portion 20, backrest 30 and base 40.

Backrest 30 preferably surrounds at least a portion of seat portion 20. As shown in the figures, backrest 30 preferably comprises a plurality of upwardly and outwardly extending members 35 arranged at least partially around a perimeter of seat portion 20. Such upwardly and outwardly extending members 35 preferably include an outward taper as members 35 extend upward. Seat portion 20 is preferably generally circular and backrest 30 preferably surrounds at least 40% of a circumference of seat portion 20.

Figure 5:
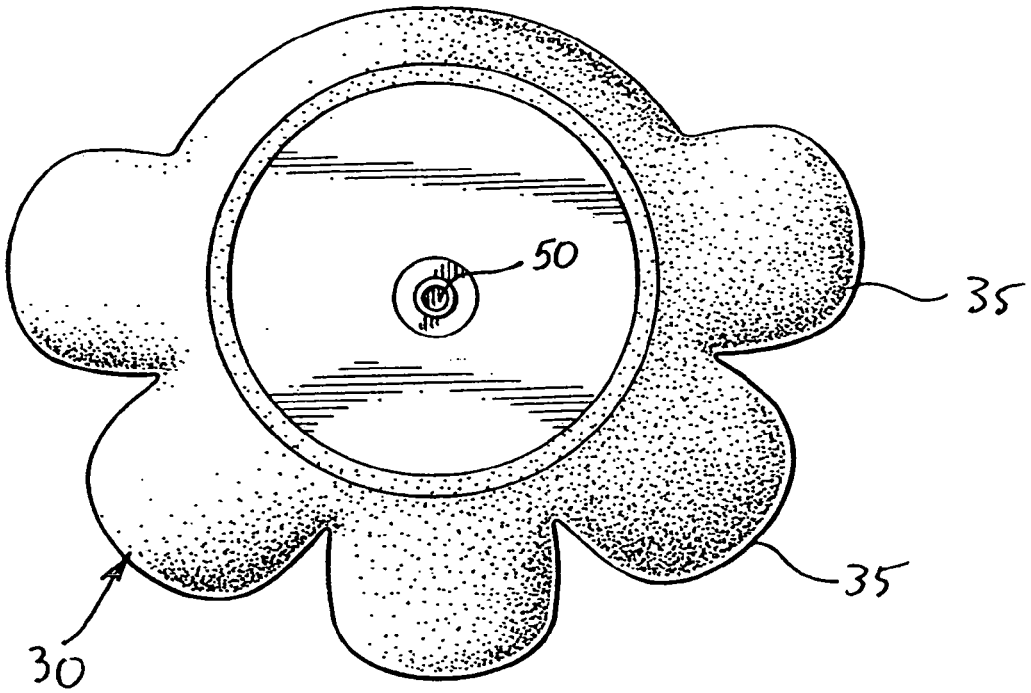
FIG. 5 is a bottom view of the chair with a base of the chair detached, according to one preferred embodiment of this invention.

According to a preferred embodiment of this invention, base 40 is removably positioned beneath seat portion 20. Preferably, base 40 is removably attached to seat portion 20 with threaded channel 50 within a bottom of seat portion 20 as shown in FIG. 5. Threaded channel 50 is preferably positioned off-center relative to a center of the bottom of seat portion 20 and, more specifically, closer to a backrest side of the bottom of seat portion 20 as shown in FIG. 5. A fastener (not shown), such as a threaded fastener is then used to connect base 40 to threaded channel 50 and thus seat portion 20. As a result of the off-center connection within seat portion 20, a center of gravity of the occupied chair is preferably biased directly over base 40 thereby preventing a user of chair 10 from tipping over backwards or forwards.

Figure 6:
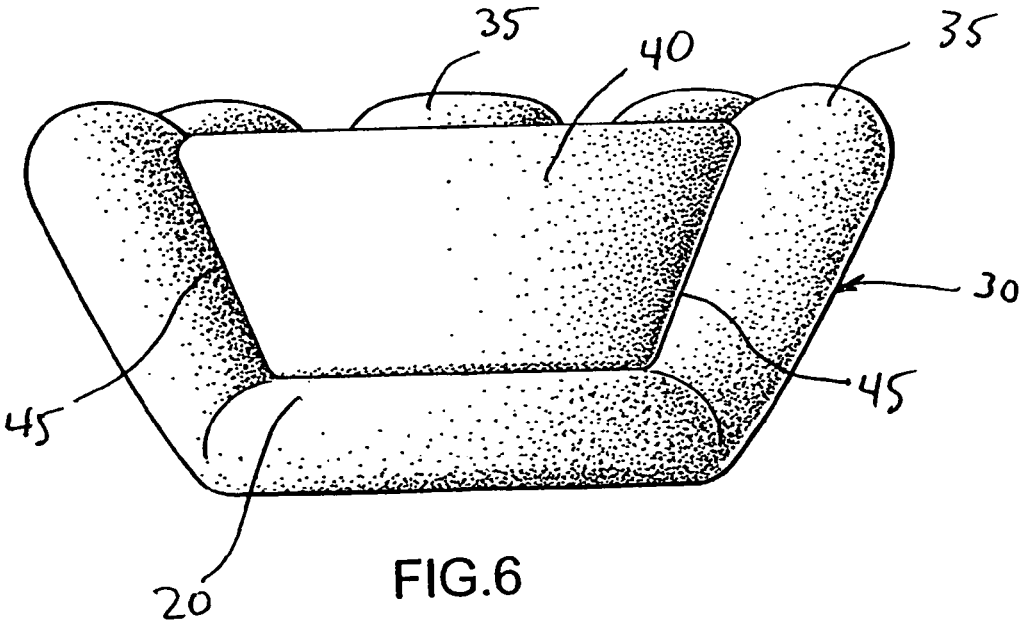
FIG. 6 is a front view of the chair, as shown in FIG. 5, with the base positioned in a seat of the chair, according to one preferred embodiment of this invention.

As shown in FIG. 1, base 40 preferably includes tapered sidewalls 45 and generally forms a conic section. Such tapered sidewalls 45 preferably inversely correspond with a taper of backrest 30 so that base 40 may be inverted and placed on seat portion 20. As shown in FIG. 6, base 40 may be inverted and nested within seat portion 20 so that a bottom of base 40 is generally flush with a top of backrest 30. More preferably, in a nested position, base 40 is entirely contained within a boundary defined by backrest 30 and seat portion 20.

Figure 8:
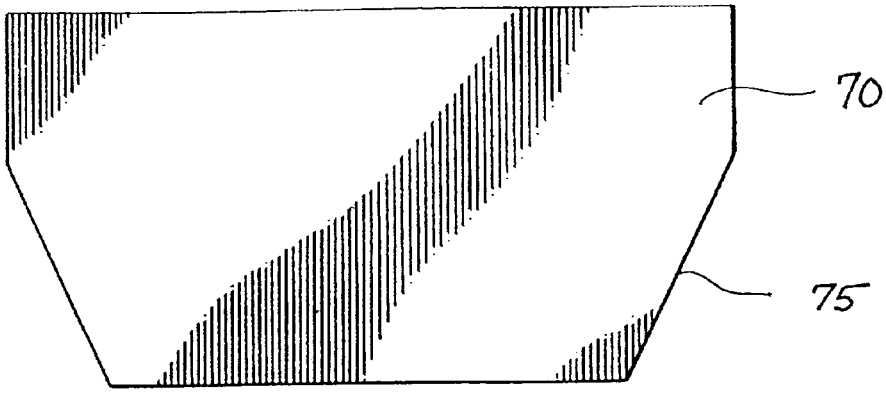
FIG. 8 is a front view of an alternate polyhedral carton having hexagonal faces for shipping and storing the chair.
Figure 7:
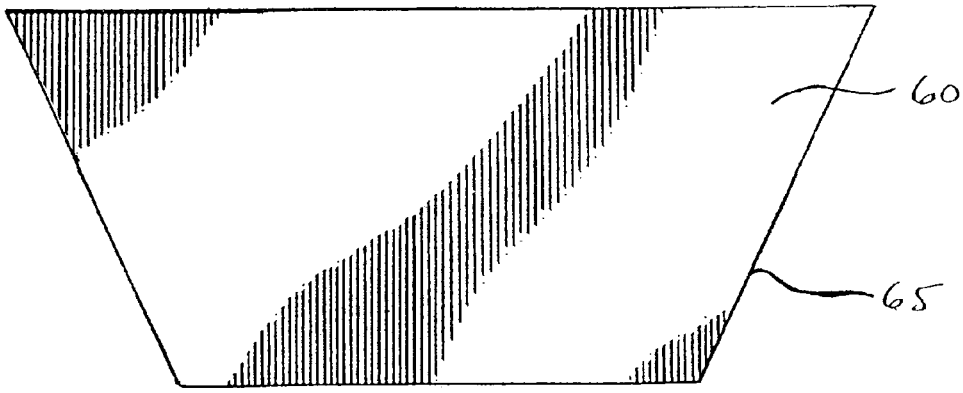
FIG. 7 is a front view of a polyhedral carton having tapered trapezoidal faces, i.e., angled side walls, for shipping and storing the chair.

Referring especially to FIGS. 6 and 7, as a result of nesting base 40 within seat portion 20 and backrest 30, chair 10 may be packaged, stored and shipped in a space-efficient manner in a nested position. Seat portion 20 containing base 40 may be packaged into a polyhedral box having at least two tapered sides on four plane faces 60, such as shown in side view with trapezoidal faces, i.e. angled sidewalls 65 in FIG. 7, so that an outer taper of backrest 30 generally corresponds with sidewall 65 of the trapezoidal box 60. FIG. 8 shows a front view of an alternate polyhedral carton 75 having hexagonal faces 70 for shipping and storing the chair in its nested position. A group of chairs 10 may thus be shipped and stored in a corresponding group of such polyhedral boxes 60 that may be arranged so that each polyhedral box 60 is inverted relative to each adjacent other polyhedral box 60 so that the tapered sidewalls, 65 or 75, overlap. Accordingly a large group of boxes 60 may be stored in a smaller area than a rectangular box by taking advantage of inverted adjacent boxes 60.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. A chair comprising:

a seat portion;

a backrest including a plurality of members extending upwardly and outwardly at a taper from the seat portion and arranged at least partially around a perimeter of the seat portion;

a base removably positioned beneath the seat portion, the base having tapered sidewalls that correspond with the taper of the plurality of upwardly and outwardly extending members such that the base is capable of being inverted on the seat portion in a nested position whereby the base is supported by the backrest and the seat portion; and whereby the base, backrest and seat portion when placed in the nested position will nest within a polyhedral box having tapered sidewalls such that an outer taper of the backrest corresponds with the taper of a sidewall of the polyhedral box.

2. The chair of claim 1, wherein the base is threadedly attachable with the seat portion through a threaded channel positioned off-center in a bottom of the seat portion.

3. The chair of claim 1 wherein, in the nested position, the base is sized so as to be entirely contained within a boundary defined by the backrest and the seat portion.

4. The chair of claim 1 wherein the seat portion is generally circular and the backrest surrounds at least 40% of a circumference of the seat portion.

5. The chair of claim 1 further comprising:

a threaded channel positioned off-center within a bottom of the seat portion; and a fastener for connecting the base to the threaded channel.

6. The chair of claim 1 wherein, in the nested position, a bottom of the base is generally flush with a top of the backrest.

7. The chair of claim 1 wherein the backrest further comprises:

five or more members arranged partially around the perimeter of the seat portion.

8. The chair of claim 1 wherein the base comprises a conic section.

* * * * *